United States Patent [19]

Giancarlo

[11] Patent Number: 4,873,857

[45] Date of Patent: Oct. 17, 1989

[54] DEVICE TO DRAW EXTRUDED STOCK FOR AN EXTRUSION PRESS

[75] Inventor: Cristiani Giancarlo, Gorizia, Italy

[73] Assignee: Danieli & C. Officine Meccaniche SpA, Buttrio, Italy

[21] Appl. No.: 193,524

[22] Filed: May 13, 1988

[30] Foreign Application Priority Data

May 22, 1987 [IT] Italy ..... 83377 A/87

[51] Int. Cl.[4] ..... B21C 35/02

[52] U.S. Cl. ..... 72/257

[58] Field of Search ..... 72/257, 290

[56] References Cited

U.S. PATENT DOCUMENTS 3,058,587 10/1962 Smith .

4,628,719 12/1986 Best .

FOREIGN PATENT DOCUMENTS 1306692 10/1962 France .

*Primary Examiner*—Lowell A. Larson

*Attorney, Agent, or Firm*—Wegner & Bretschneider

[57] ABSTRACT

Device to draw extruded stock for an extrusion press, in which downstream of an extrusion press (11) is a withdrawal track (15) cooperating with two carriages (21) bearing engagement vices (24), an endless runway (20) being comprised in coordination with the withdrawal track (15) and having one segment (115) parallel to the withdrawal track (15) and bearing the two carriages (21), the endless runway (20) including two straight segments (115–215) and two connecting bends (22) and at least one switch point (120) and a parking line (315) for the carriages (21).

16 Claims, 4 Drawing Sheets

DEVICE TO DRAW EXTRUDED STOCK FOR AN EXTRUSION PRESS

Figure 1A:
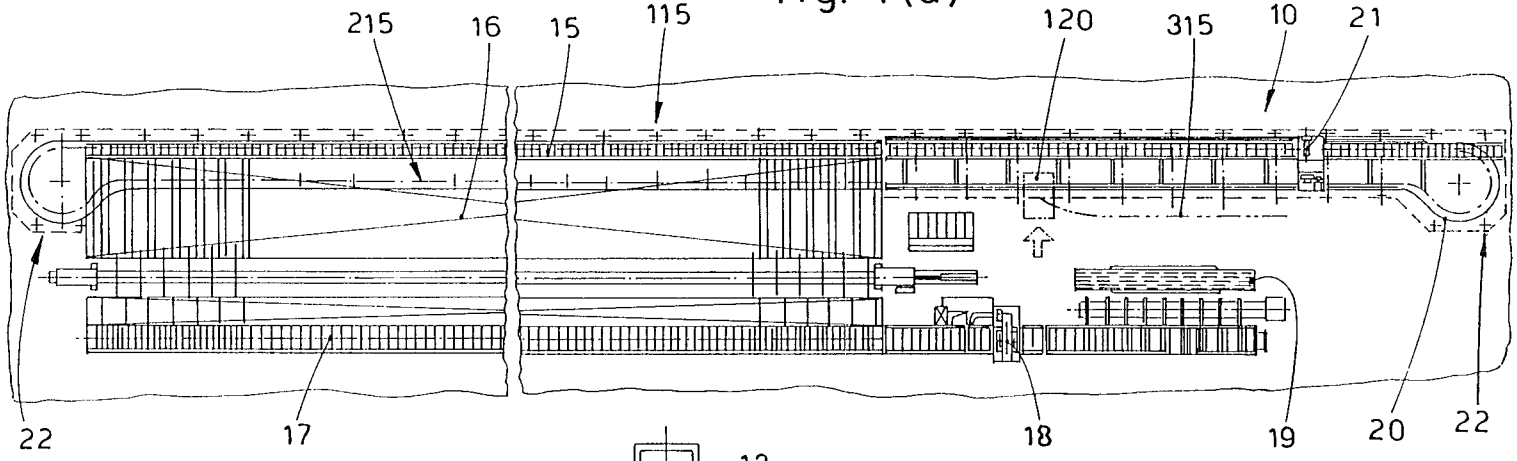

The present invention concerns a device to draw extruded sections leaving extrusion presses. To be more exact, the invention concerns a device able to cooperate with the extrusion press in drawing extruded sections extruded by the action of the extrusion press.

Extrusion presses are known which produce extruded sections consisting of aluminium, copper, steel and alloys of various types. These presses start with a heated block of metal and extrude it through one or more dies, thus producing one or more extruded sections having the required geometric characteristics.

These extruded sections normally have a length of various tens of meters. Their length depends on the weight per unit of length of the section and on the weight of the block placed within the extrusion press.

When extrusion of a section has started, the section undergoes an entraining action exerted by drawing means. These drawing means serve to help both the press and the extruded section, so that the extruded section does not become deformed lengthwise and does not take up undesired shapes lengthwise and therefore also transversely.

The prior art comprises various systems now in use. A first system provides for one single vice which runs along a rail and draws the section being extruded.

However, this system involves very long downtimes during the return travel of the vice and therefore the processing times too are relatively long. In fact, although the return travel of the vice is speeded up in relation to its forward travel, yet the return travel times are very long and keep the press halted for periods which are considerable as a percentage of the whole process. A press halted for a long time entails considerable loss owing to lost output.

Next, a system was designed with two carriages running on one single straight track. In this system a first carriage performs the drawing action up to about halfway along the track and then stops and delivers the extruded stock to a second carriage, which has been positioned in the meantime.

This second carriage completes the second half of the drawing travel, while the first carriage returns to the neighbourhood of the press and positions itself to engage the next section.

While the extruded section is passing from one carriage to the other, the press is halted momentarily or is at least slowed down.

During this stoppage or slowing down, a zone on the extruded section is formed which is affected by this transient period of stoppage or slowing of the press and undergoes a sharp drop in quality, which usually makes necessary the elimination of that zone.

A conveyor belt system has also been disclosed on which the extruded section is deposited and then caused to advance in coordination with the conveyor belt, which is sometimes slightly accelerated in relation to the extruded section. Although this system does not involve downtimes, yet it entails problems of continuity, breakdowns of the conveyor belt and a surface quality of the extruded stock which is not always acceptable.

Moreover, it does not allow performance of the required drawing of the extruded material, such drawing being especially advantageous when carried out during the extruding step.

FR 1.306.692 has been proposed and discloses an endless overhead runway with a drawing device positioned below it. This disclosure involves problems of maintenance and replacement of carriages, vertical overall bulk, limited applied power, control of the extruded stock, etc., and these problems make this proposal unsatisfactory.

U.S. Pat. No. 4,628,719 also discloses a very complex and complicated beam, which entails heavy costs of production, maintenance and installment.

U.S. Pat. No. 3,058,587 discloses a drawing system with multiple carriages for the extrusion, but this drawing system not only provides only a linear to-and-fro development but also unimportant applied forces.

To obviate the above shortcomings, the present applicant has designed, tested and embodied the device according to the invention.

The invention provides a device comprising at least two vice-holder drawing carriages in cooperation with an extrusion press. These drawing carriages run on an endless runway which comprises at least one segment positioned in such a way that the carriages move substantially along the axis of the departure of the extruded sections from the extrusion press.

According to the invention the carriages are driven on an overhead runway and cooperate with a slide track on which the extruded sections are rested.

As the drawing carriages cooperate with an overhead runway, they can move along such endless runway independently of the extruded stock and can position themselves in relation to the latter at any position and time.

As we said earlier, the device provides for at least two drawing carriages, thus enabling them to be moved as required, so that while one carriage is performing a drawing action, the other carriage can be positioned freely.

Moreover, the device arranges that during their drawing step the drawing carriages travel at a controlled speed coordinated with the extrusion speed.

Furthermore, the inclusion of a shears along the slide track assists the operations of butting, shearing to size and releasing the sections for the drawing carriages.

In a variant more than two carriages are provided and cooperate with switch points, which enable the carriages to be replaced and parked in a maintenance area without the runway being in any way occupied.

The invention is therefore disclosed and embodied according to the contents of the main claim. The dependent claims disclose possible variants of the invention.

Figure 1B:
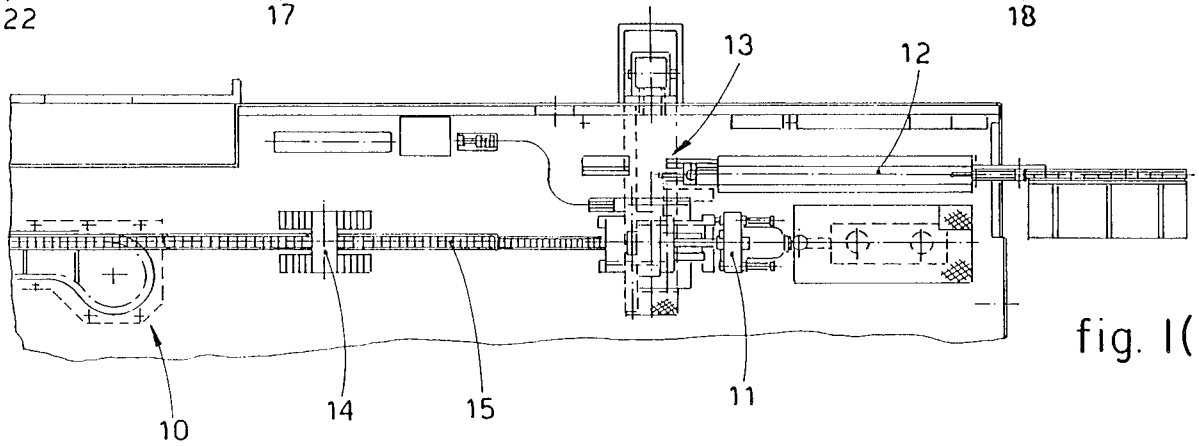
Figure 2:
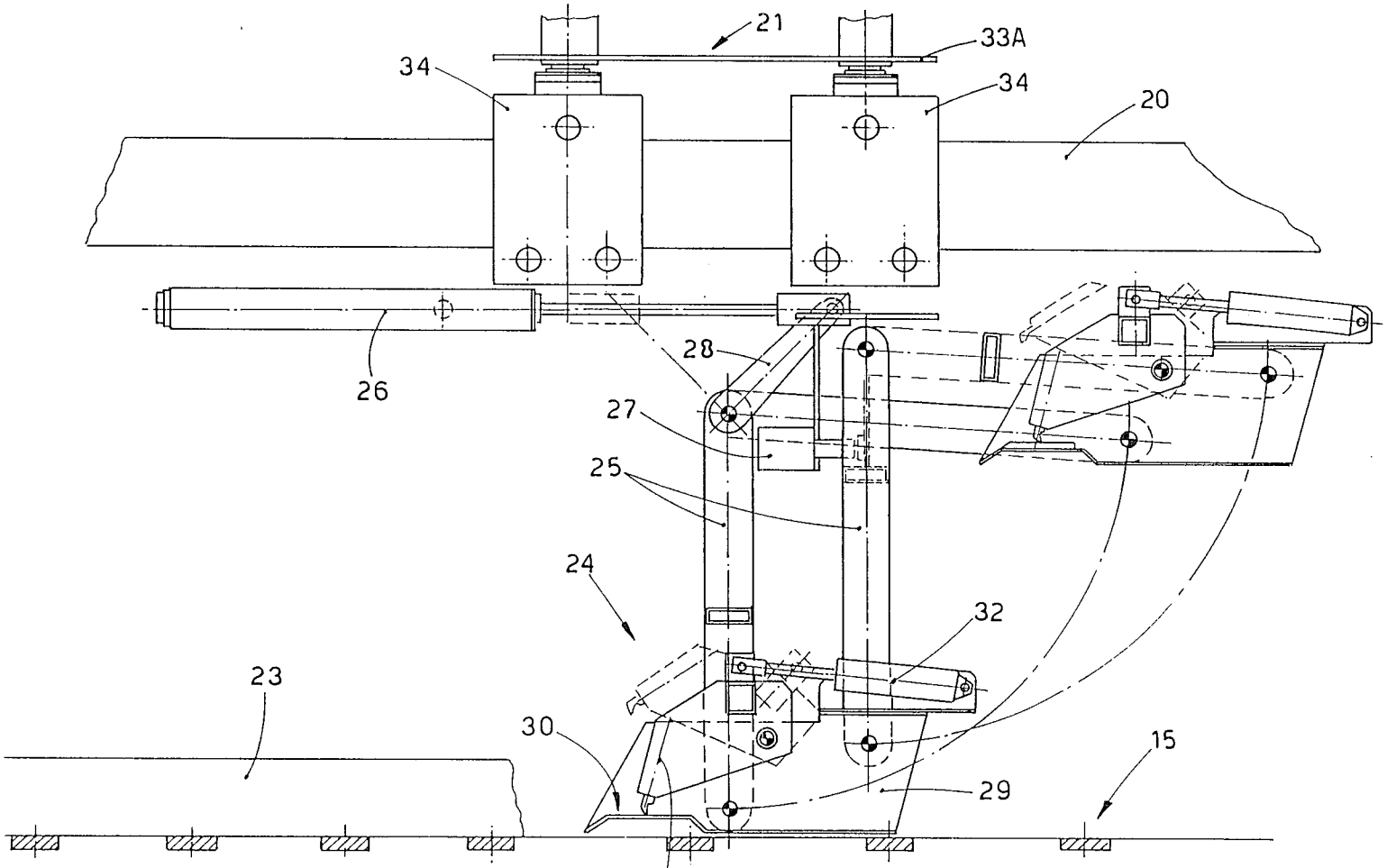
Figure 3:
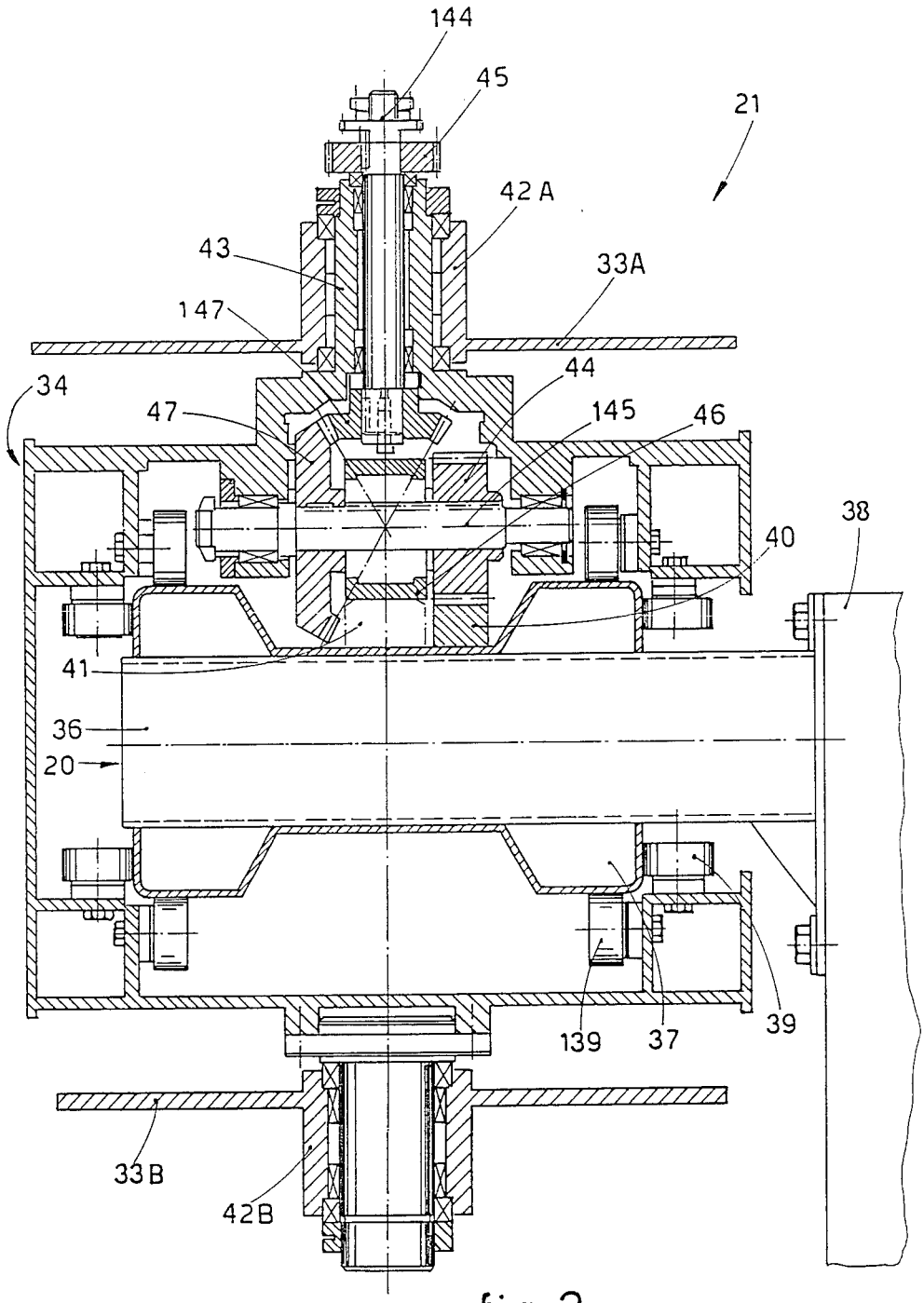
Figure 4:
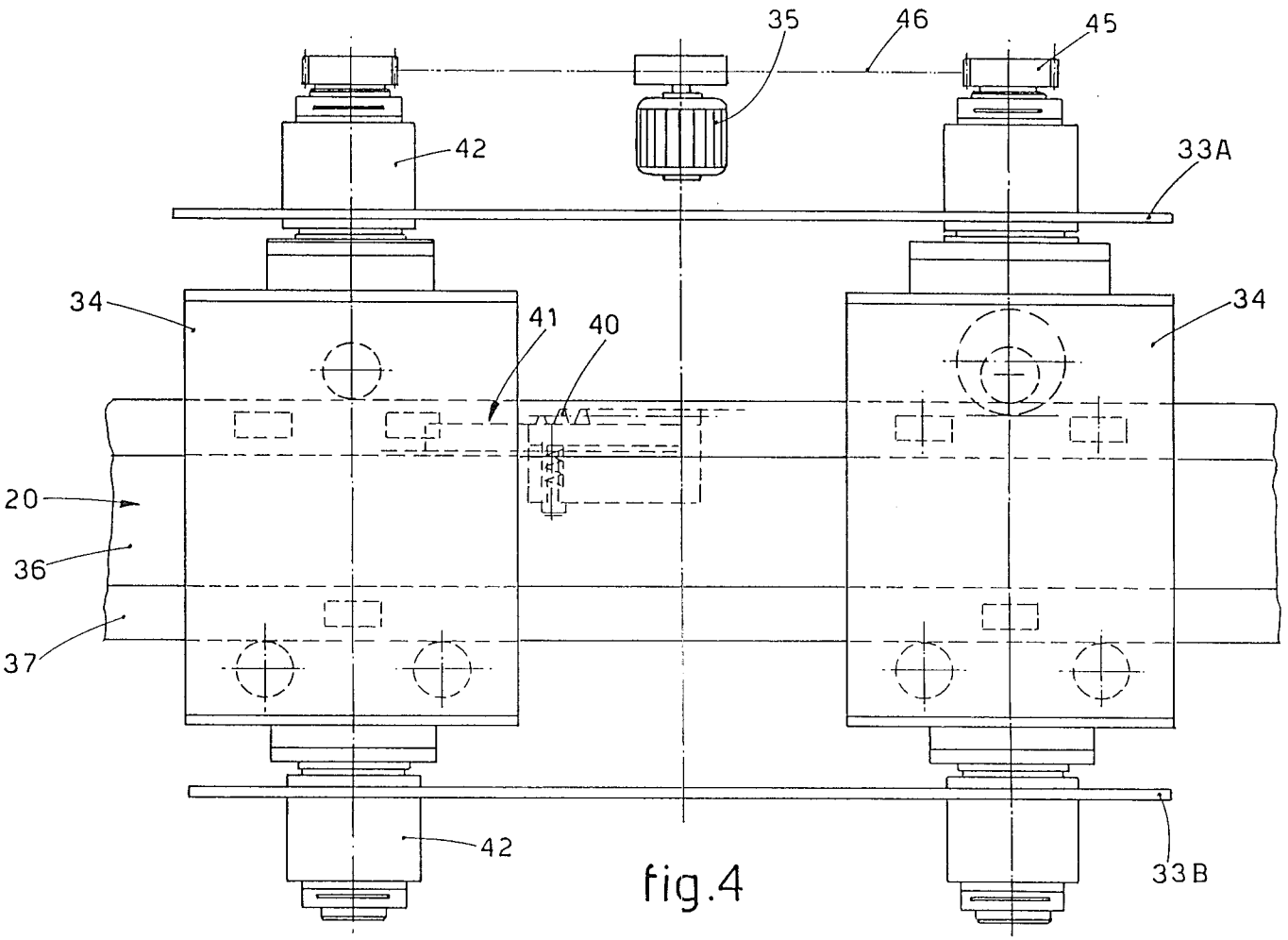

Let us now see a preferred embodiment of the invention with the help of the attached figures, which are given as a non-restrictive example. The figures show the following:

FIG. 1*a* & 1*b* give a plan view of a drawing device applied to an extrusion press;

FIG. 2 gives a side view of a drawing carriage;

FIG. 3 shows a cross section of a carriage forming the drawing carriage;

FIG. 4 gives a side view of a drawing carriage.

In FIG. 1 an extrusion press 11 is served by a heating furnace 12 and a charging unit 13. Downstream of the extrusion press 11 is a withdrawal track 15, with which there cooperate a shears 14 and, downstream of the shears 14, a drawing device 10 according to the invention.

A cooling plate 16 is located in cooperation with the terminal portion of the withdrawal track 15 and cooperates with a roller conveyor 17, a facing shears 18 and a stacker machine 19 to stack bundles of extruded stock.

An endless runway 20, here an overhead runway, cooperates with the drawing device 10 and comprises a segment 115 positioned above the withdrawal slide track 15 and a segment 215 substantially parallel to the withdrawal slide track 15 and also two connecting bends 22.

In a variant the endless overhead runway 20 comprises switch points 120, which enable the parallel segment 215 or another segment to be connected momentarily to a parking line 315 where the drawing carriages 21 are parked and undergo maintenance.

The endless overhead runway 20 comprises a plurality of supports 38 which uphold support bars 36 to which guides 37 are fitted.

The straight portions of the runway 20 include racks 40, whereas the connecting bends 22 comprise friction paths 41.

The racks 40 and friction paths 41 are solidly fixed to the overhead runway 20.

A drawing carriage 21 is enabled to slide on the overhead runway 20. A drawing device 10 provides for at least two drawing carriages 21.

The drawing carriages 21 includes an upper connection frame **33*a* and a lower connection frame 33*b*; each of the connection frames 33 comprises a bush 42*a* and 42*b*** respectively.

One single trolley 34 is free to cooperate with the bushes **42*a* and 42*b* and to oscillate therein. The single trolley 34 runs on guides 37 by means of a plurality of rollers 139 having a horizontal axis and of rollers 39** having a vertical axis.

The guides 37 together with the support bars 36 form the endless overhead runway 20.

The rollers 39 and 139 may be installed on eccentric bushes for proper regulation, positioning and leveling of the drawing carriage. One drawing carriage 21 consists of two single trolleys 34.

The two single trolleys 34 are able to oscillate in the connecting frame so as to enable the drawing carriage to adapt itself to the connecting bends 22 and to the curves of any switch points 120.

A motor 35 is positioned on the upper connecting frame **33*a* and transmits motion to upper gear wheels 45 through a drive chain 46**.

The upper gear wheels 45 are integrally fixed to a shaft 144, which sets a drive shaft 145 in rotation through bevel gears 47–147.

A lower gear wheel 44 and a friction wheel 46 are integrally fixed to the drive shaft 145. The lower gear wheel 44 cooperates with the rack 40, whereas the friction wheel 46 cooperates with the friction path 41.

Thus, the lower gear wheel 44 drives the drawing carriage 21 at the required speed along the straight portions of the overhead runway, whereas at the bends the lower gear wheel 44 is disengaged automatically where the rack 40 does not exist.

At the bends it is the friction wheel 46 which functions in cooperation with the friction path 41 in the absence of the rack 40 and enables the drawing carriage 41 to move freely along the bends 22 too.

The cooperation of the lower gear wheel 44 with the rack 40 makes possible a coordinated control of the speed of the drawing carriage 21.

In the example shown a parallelogram of levers 25 is fitted to the drawing carriage 21 and can be actuated by a lever 28 of a first jack 26. A shock absorber 27 serves to cushion the working position taken up by the parallelogram of levers 25.

An engagement vice 24 is fitted terminally to the parallelogram of levers 25 and comprises a bench 29 with a support surface 30 and a clamping jaw 31 actuated by a second jack 32.

An extruded section 23 runs along the withdrawal slide track 15 and comes to rest on the support surface 30, while the clamping jaw 31, being actuated by the second jack 32, clamps the extruded section 23 on the support surface 30.

The conformation of the clamping jaw 31 is such that the clamping force increases as the drawing force increases.

I claim:

1. Device to draw extruded stock for an extrusion press, in which downstream of an extrusion press (11) is a withdrawal track (15) cooperating with two carriages (21) bearing engagement vices (24), an endless runway (20) being comprised in coordination with the withdrawal track (15) and having one segment (115) parallel to the withdrawal track (15) and bearing the two carriages (21), the endless runway (20) including two straight segments (115-215) and two connecting bends (22), the device being characterized in that the endless runway (20) comprises at least one switch point (120) and a parking line (315) for the carriages (21).

2. Device as claimed in claim 1, in which each of the drawing carriages comprises two individual trolleys.

3. Device as claimed in claim 2, in which the individual trolleys are anchored oscillatably to upper and lower connection frames and have their axes parallel to each other and normal to the plane of the positioning of the endless runway.

4. Device as claimed in claim 1, wherein each of the drawing carriages comprises two individual trolleys and wherein each individual trolley comprises a plurality of rollers having a horizontal axis and a plurality of rollers having a vertical axis.

5. Device as claimed in claim 4, wherein the individual trolleys are anchored oscillatably to upper and lower connection frames and have their axes parallel to each other and normal to the plane of the positioning of the endless runway; and wherein motion is provided by a motor borne on the upper connection frame.

6. Device as claimed in claim 4, wherein the individual trolleys are anchored oscillatably to upper and lower connection frames and have their axes parallel to each other and normal to the plane of the positioning of the endless runway; and wherein the engagement vices are upheld by the lower connection frame, can be moved vertically, and comprise a bench with a support surface and a clamping jaw.

7. Device to draw extruded stock for an extrusion press, in which downstream of an extrusion press is a withdrawal track cooperating with two carriages bearing engagement vices, an endless runway being comprised in coordination with the withdrawal track and having one segment parallel to the withdrawal track and bearing the two carriages, the endless runway including two straight segments and two connecting bends, the device being characterized in that the endless runway comprises at least one switch point and a parking line for the carriages; wherein the endless runway comprises entraining racks on the straight segments and friction paths on the connection bends and points.

8. Device as claimed in claim 7 in which the drawing carriages comprise lower gear wheels cooperating with the entraining racks and friction wheels cooperating with the friction paths.

9. Device as claimed in claim 8, in which each of the drawing carriages comprises two individual trolleys and in which the individual trolleys comprise means to receive motion and means to transmit motion to the lower gear wheel and the friction wheel.

10. Device as claimed in claim 7, wherein each of the drawing carriages comprises two individual trolleys.

11. Device as claimed in claim 10, wherein each individual trolley comprises a plurality of rollers having a horizontal axis and a plurality of rollers having a vertical axis.

12. Device as claimed in claim 10, wherein the individual trolleys are anchored oscillatably to upper and lower connection frames and have their axes parallel to each other and normal to the plane of the positioning of the endless runway.

13. Device as claimed in claim 12, wherein motion is provided by a motor borne on the upper connection frame.

14. Device as claimed in claim 12, wherein the engagement vices are upheld by the lower connection frame, can be moved vertically, and comprise a bench with a support surface and a clamping jaw.

15. Device to draw extruded stock for an extrusion press, in which downstream of an extrusion press is a withdrawal track cooperating with two carriages bearing engagement vices, an endless runway being comprised in coordination with the withdrawal track and having one segment parallel to the withdrawal track and bearing the two carriages, the endless runway including two straight segments and two connecting bends, the device being characterized in that the endless runway comprises at least one switch point and a parking line for the carriages;

wherein each of the drawing carriages comprises two individual trolleys;

wherein the individual trolleys are anchored oscillatably to upper and lower connection frames and have their axes parallel to each other and normal to the plane of the positioning of the endless runway; and wherein motion is provided by a motor borne on the upper connection frame.

16. Device to draw extruded stock for an extrusion press, in which downstream of an extrusion press is a withdrawal track cooperating with two carriages bearing engagement vices, an endless runway being comprised in coordination with the withdrawal track and having one segment parallel to the withdrawal track and bearing the two carriages, the endless runway including two straight segments and two connecting bends, the device being characterized in that the endless runway comprises at least one switch point and a parking line for the carriages;

wherein each of the drawing carriages comprises two individual trolleys;

wherein the individual trolleys are anchored oscillatably to upper and lower connection frames and have their axes parallel to each other and normal to the plane of the positioning of the endless runway; and wherein the engagement devices are upheld by the lower connection frame, can be moved vertically and comprise a bench with a support surface and a clamping jaw.

* * * * *